US007397338B2

(12) United States Patent
Sano et al.

(10) Patent No.: US 7,397,338 B2
(45) Date of Patent: Jul. 8, 2008

(54) INDUCTOR

(75) Inventors: Kan Sano, Tokyo (JP); Yuichi Kamio, Tokyo (JP)

(73) Assignee: Sumida Corporation, Tokyo (JP)

( * ) Notice: Subject to any disclaimer, the term of this patent is extended or adjusted under 35 U.S.C. 154(b) by 0 days.

(21) Appl. No.: 11/683,126

(22) Filed: Mar. 7, 2007

(65) Prior Publication Data

US 2007/0216512 A1 Sep. 20, 2007

(30) Foreign Application Priority Data

Mar. 16, 2006 (JP) ..... 2006-072694

(51) Int. Cl.
*H01F 27/24* (2006.01)
*H01F 5/00* (2006.01)
*H01F 27/28* (2006.01)

(52) U.S. Cl. ..... 336/212; 336/192; 336/198; 336/200

(58) Field of Classification Search ..... 336/212, 336/83, 220, 223, 232, 200, 198, 192
See application file for complete search history.

(56) References Cited

U.S. PATENT DOCUMENTS

| | | | | |
|---|---|---|---|---|
| 6,621,397 | B2 * | 9/2003 | Hsu | 336/96 |
| 6,707,366 | B2 * | 3/2004 | Hsu et al. | 336/200 |
| 6,774,755 | B2 * | 8/2004 | Nakata et al. | 336/83 |
| 2004/0108929 | A1 * | 6/2004 | Ichikawa et al. | 336/83 |
| 2006/0279395 | A1 * | 12/2006 | Lee et al. | 336/221 |

FOREIGN PATENT DOCUMENTS

| | | |
|---|---|---|
| JP | 2004-207371 | 7/2004 |

* cited by examiner

*Primary Examiner*—Anh T Mai
(74) *Attorney, Agent, or Firm*—Reed Smith LLP

(57) ABSTRACT

In substrate-mounting type inductor having a winding having conductivity, a core on which the winding is winded, and a terminal portion arranged at an end of the winding, a recessed portion which is recessed in a direction of height of the core is formed on a substrate mounting surface of the core, and the terminal portion is arranged to be housed in the recessed portion through an insulating member.

7 Claims, 8 Drawing Sheets

INDUCTOR

CLAIM OF PRIORITY

This application claims the benefit of Japanese Patent Application No. 2006-072694 filed on Mar. 16, 2006, the entire contents of which are hereby incorporated by reference herein.

BACKGROUND OF THE INVENTION

1. Field of the Invention

The present invention relates to an inductor used in various electric appliances such as a mobile phone, a personal computer, and a television set.

2. Description of the Related Art

As conventional inductors, inductors which use a magnetic material such as an Ni—Zn-based ferrite or an Mn—Zn-based ferrite as a core material thereof are known. However, when an Mn—Zn-based ferrite is used as a core material in an inductor, insulation failure may occur between a winding and a core. Therefore, in an inductor which uses a core consisting of a magnetic material such as an Mn—Zn-based ferrite, a mounting substrate must be electrically insulated from the core.

In a choke coil disclosed in Japanese Patent Application Laid-Open No. 2004-207371 (FIG. 1), a resin molding body having a connection terminal to which an end of a winding is connected is arranged below a bottom surface portion of a core on which the winding is winded. In this manner, the resin molding body is arranged below the core to electrically insulate a mounting substrate on which the choke coil is mounted from the core.

However, in the choke coil disclosed in Japanese Patent Application Laid-Open No. 2004-207371 (FIG. 1), the resin molding body is interposed between the core and the mounting substrate. For this reason, the dimension of the choke coil in the direction of height is disadvantageously increased by a thickness of the resin molding body. When the configuration is applied to the inductor, the same problem is posed.

SUMMARY OF THE INVENTION

The present invention has been made on the basis of the above circumstances, and has as its object to provide an inductor which can secure insulating property and can achieve a low profile.

In order to solve the above problem, according to an aspect of the present invention, there is provided a substrate-mounting type inductor having a winding having conductivity, a core on which the winding is winded, and a terminal portion arranged at an end of the winding, wherein a recessed portion which is recessed in a direction of height of the core is formed on a substrate mounting surface of the core, and the terminal portion is arranged to be housed in the recessed portion through an insulating member.

In this configuration, the terminal portion is arranged in the recessed portion recessed from the substrate mounting surface in the direction of height of the core. For this reason, the dimension of the core in the direction of height corresponding to the height of the recessed portion can be effectively utilized. As a result, a low-profile inductor can be achieved. The insulating member is interposed between the terminal portion and the recessed portion. For this reason, electric insulating property between the mounting substrate and the core can be secured. Furthermore, the insulating member has a size to be housed in the recessed portion, the insulating member does not project outside the inductor. As a result, the inductor can be suppressed from increasing in size.

According to another aspect of the invention, a winding is constituted by a flat wire, and an end of the flat wire is used as a terminal portion in the configuration of the above aspect of the invention. With this configuration, since the end of the flat wire can be used as the terminal portion, another terminal need not to be arranged. Therefore, the configuration of the inductor is simplified, and the number of parts can be reduced.

According to still another aspect of the invention, parts of a terminal portion and an insulating member located on a side surface side of a core are arranged on the same plane as that of the side surface of the core in the configuration of the above aspect of the invention. With this configuration, since both the terminal portion and the insulating member do not project outside the inductor, the inductor can be suppressed from increasing in size in a horizontal direction.

According to still another aspect of the invention, there is provided an inductor in which the core in the above respective aspects of the invention is constituted by two cores, an E-type core having a middle leg which supports a winding is used as one core, and a plate-like I-type core arranged to cover an open surface of the E-type core is used as the other core.

According to still another aspect of the invention, there is provided an inductor in which the recessed portion in the above aspects of the invention is formed on a surface of the I-type core.

According to the present invention, the insulating property of the inductor can be secured, and the inductor can achieve a low profile.

DESCRIPTION OF THE PREFERRED EMBODIMENTS

First Embodiment

An inductor 10 according to a first embodiment of the present invention will be described below with reference to the accompanying drawings.

Figure 1:
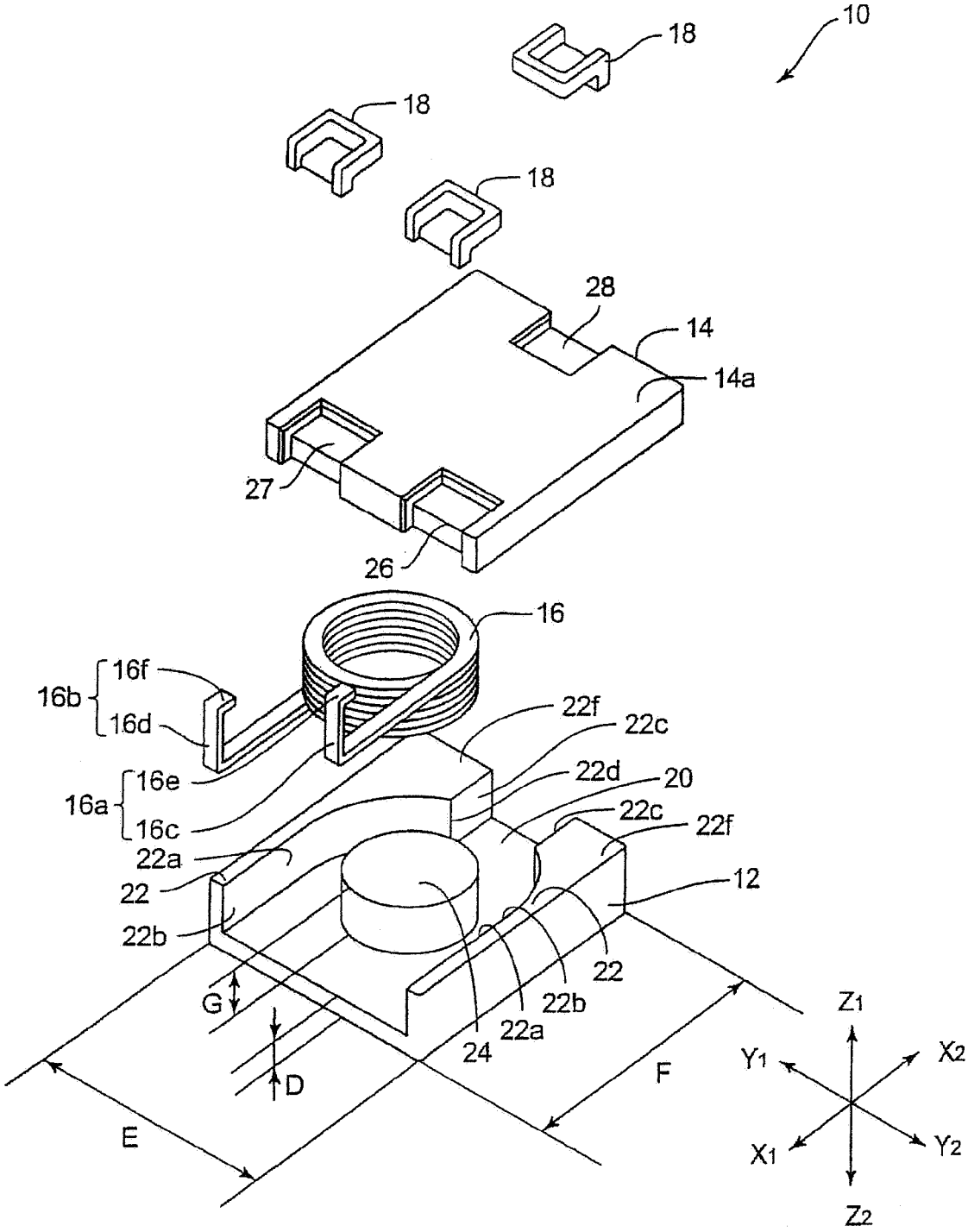
FIG. 1 is an exploded perspective view showing the configuration of an inductor according to a first embodiment of the present invention and showing a state in which a surface mounted on a substrate faces upward.
Figure 2A:
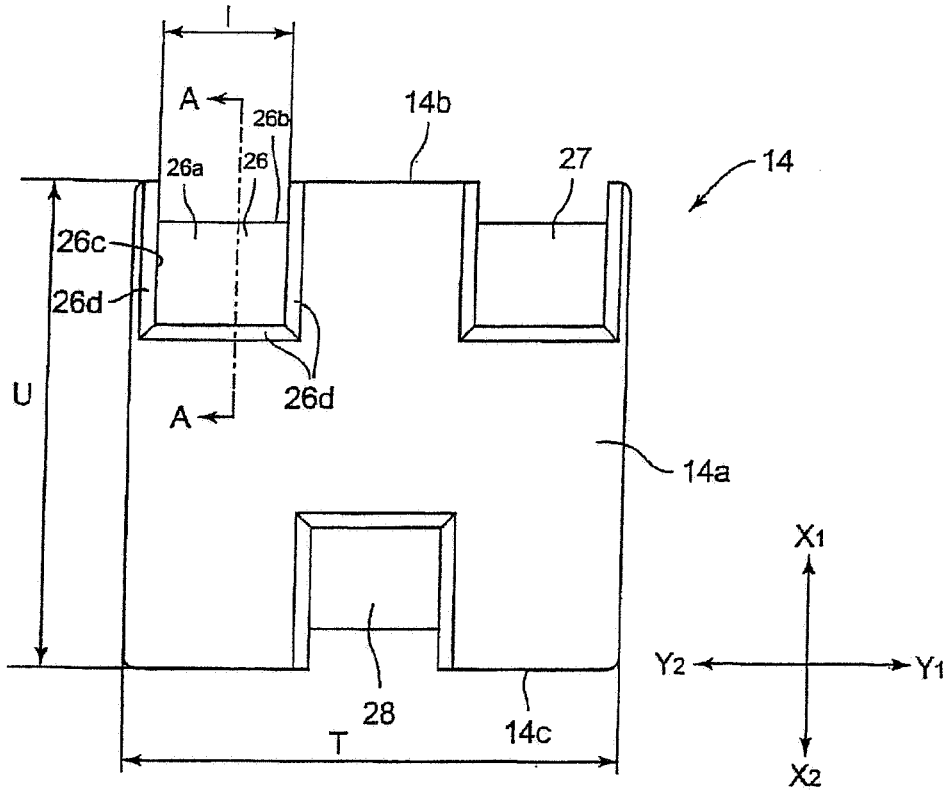
FIG. 2A is a plan view showing the configuration of an I-type core in FIG. 1.
Figure 2B:
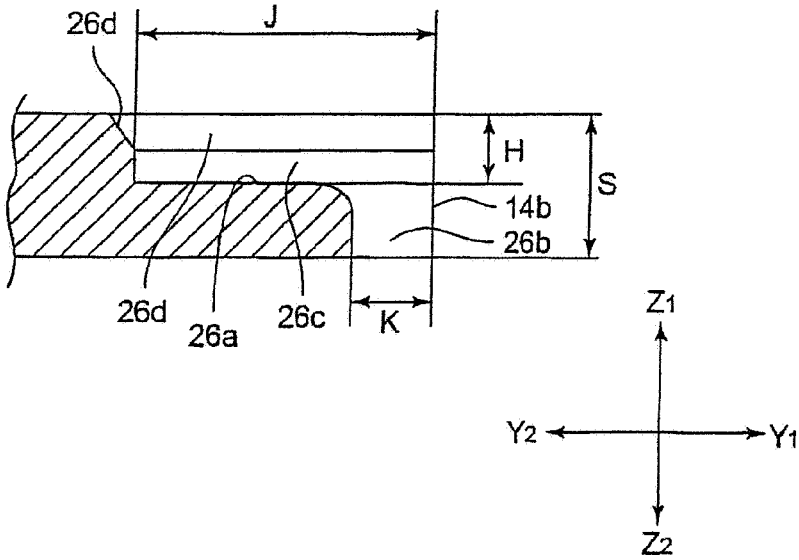
FIG. 2B is a sectional view of the I-type core cut along an A-A line in FIG. 2A.

FIG. 1 is an exploded perspective view showing the configuration of the inductor 10 according to the first embodiment of the present invention and showing a state in which a surface mounted on a substrate faces upward. FIG. 2A is a plan view showing the configuration of an I-type core in FIG. 1, and FIG. 2B is a sectional view of the I-type core cut along an A-A line in FIG. 2A. In the following explanation, in FIGS. 1, 2A, 2B and FIGS. 4 to 8, a direction indicated by an arrow X1 shown is defined as a left side, a direction indicated by an arrow X2 is defined as a right side, a direction indicated by an arrow Y1 is defined as a rear side, a direction indicated by an arrow Y2 is defined as a front side, a direction indicated by an arrow Z1 is defined as an upper side, and a direction indicated by an arrow Z2 is defined as a lower side.

The inductor 10, as shown in FIG. 1, is a surface-mount type inductor which is mainly constituted by an E-type core 12, an I-type core 14, a winding 16, and an insulating member 18 consisting of a resin.

The E-type core 12, as shown in FIG. 1, has a planar bottom surface portion 20, a wall portion 22 uprightly extending from both of a depth side and a front side of the bottom surface portion 20, and a winding core portion (middle leg) 24 penetratively formed at an almost center of the bottom surface portion 20. The E-type core 12 consists of a magnetic material such as Mn—Zn-based ferrite. As the material of the E-type core 12, for example, a magnetic material such as a permalloy, sendust, iron, or carbonyl may be used.

The bottom surface portion 20 has an almost square planar shape. One pair of wall portions 22 uprightly extend from both the ends on the rear side and the front side in opposite to each other. An inner wall surface 22*a* of the wall portion 22 has a curved surface portion 22*b* and a planar portion 22*c*. The curved surface portion 22*b*, as shown in FIG. 1, has a curved surface which is internally curved from the left side to the right side. The planar portion 22*c* has an almost rectangular planar shape, and is formed to be adjacent to the right side of a right end 22*d* of the curved surface portion 22*b*. The winding core portion 24 projecting upwardly and having a columnar shape is formed at an almost center of the bottom surface portion 20. The wall portion 22 and the winding core portion 24 are formed to have equal levels. A height D, a width E, and a length F of the bottom surface portion 20 are 1.3 mm, 10.2 mm, and 10.0 mm, respectively. These dimensions are not limited to the values. Heights G of the wall portion 22 and the winding core portion 24 are 2.5 mm each. However, the heights G are not limited to the value.

As shown in FIG. 1, the winding 16 is fitted on the winding core portion 24 and arranged to be brought into contact with the inner side of the wall portion 22 and the bottom surface portion 20. The winding 16 is formed by coaxially winding a flat wire having conductivity and covered with an insulating film such as an enamel film in advance. As a material of the flat wire, a metal such as copper having good conductivity is preferably used. However, a metal such as iron or aluminum may be used. An end 16*a* and an end 16*b* of the winding 16 extend in a direction tangent to the cylinder of the winded winding 16. The end 16*a* and the end 16*b* have bent portions 16*c* and 16*d* bent downward and folded portions 16*e* and 16*f* folded from the distal ends of the bent portions 16*c* and 16*d* in a direction tangent to the winding 16, respectively. The folded portions 16*e* and 16*f* are terminals which are not covered with an insulating film and which can be electrically connected to an external device.

After the winding 16 is fitted on the winding core portion 24, the I-type core 14 is arranged above the E-type core 12 to close an opening portion above the E-type core 12. The I-type core 14, as shown in FIGS. 1, 2A and 2B, is a core member having a planar shape. As shown in FIGS. 2A and 2B, a height S, a width T, and a length U of the I-type core 14 are 1.4 mm, 10.2 mm, and 10.0 mm, respectively. The width T and the length U are equal to the width E and the length F of the E-type core 12, respectively. The I-type core 14 consists of a magnetic material such as an Mn—Zn-based ferrite. As a material of the I-type core 14, for example, a magnetic material such as a permalloy, sendust, iron, or carbonyl may be used.

As shown in FIGS. 1 and 2A, two recessed portions 26 and 27 are arranged from the front side to the rear side near a left-side end face 14*b* on a substrate mounting surface 14*a* of the I-type core 14. A recessed portion 28 is formed near the center of a right-side end face 14*c* on the substrate mounting surface 14*a* of the I-type core 14.

More specifically, as shown in FIGS. 2A and 2B, a recessed portion 26 is formed to be recessed downward from the substrate mounting surface 14*a* by a height H from the left-side end face 14*b* to a predetermined position located inside the I-type core 14. In the embodiment, although the height H of the recessed portion 26 is set at 0.7 mm, the height H is not limited to the value. Although a width I and a depth J of the recessed portion 26 are set at 2.7 mm and 2.9 mm, respectively, the width I and the depth J are not limited to the values. A bottom surface 26*a* of the recessed portion 26 is not formed near the left-side end face 14*b* of the recessed portion 26. A portion near the left-side end face 14*b* is a notched portion 26*b* internally notched from the left-side end face 14*b*. In the embodiment, although a depth K of the notched portion 26*b* is set at 0.8 mm, the depth K is not limited to the value. Tapers 26*d* are formed in boundary portions between the substrate mounting surface 14*a* and three inner-wall surfaces 26*c* forming the recessed portion 26. The taper 26*d* is an inclination to smoothly fit the insulating member 18 shown in FIGS. 3A, 3B and 3C. The shapes of the recessed portion 27 and the recessed portion 28 are the same as that of the recessed portion 26. Therefore, explanation of the structures of the recessed portions will not be described.

Figure 3A:
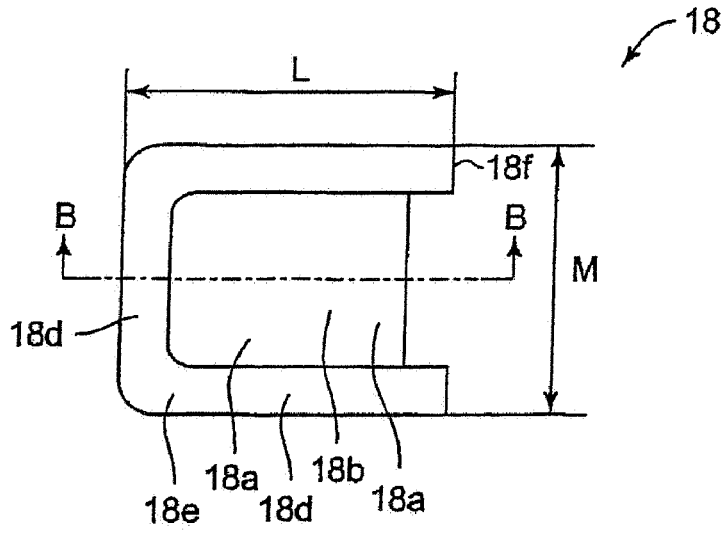
FIG. 3A is a plan view showing the configuration of an insulating member in FIG. 1.
Figure 3B:
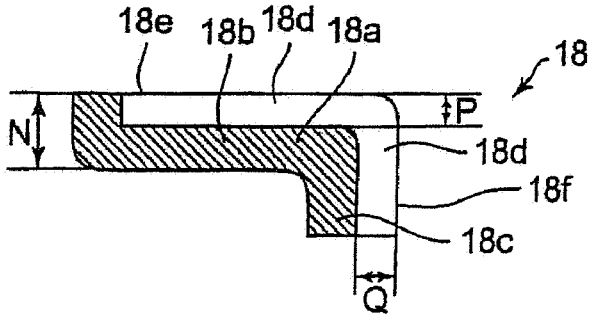
FIG. 3B is a sectional view of the insulating member cut along a B-B line in FIG. 3A.
Figure 3C:
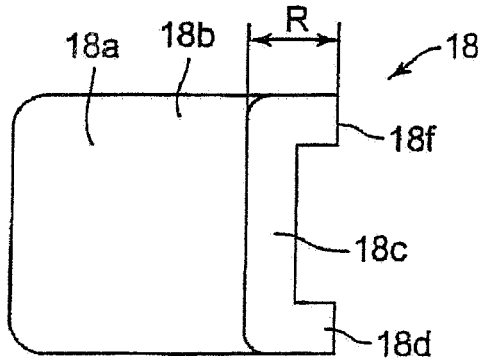
FIG. 3C is a back view of the insulating member.

FIG. 3A is a plan view showing the configuration of the insulating member 18, and FIG. 3B is a sectional view of the insulating member 18 cut along a B-B line in FIG. 3A, and FIG. 3C is a back view of the insulating member.

As shown in FIG. 1, the insulating members 18 are arranged in the recessed portions 26, 27, and 28, respectively. A material of the insulating member 18 is a resin such as polyethylene or polypropylene. The insulating member 18, as shown in FIG. 1 and FIGS. 3A to 3C, has a substrate portion 18*a* having an L-shaped section and comprising a planar portion 18*b* and a side-plate portion 18*c*. At an edge of the substrate portion 18*a* except for a lower end of the side-plate portion 18*c* (end faces on the left side, the front side, and the rear side of the planar portion 18*b* and end faces on the front side and the rear side of the side-plate portion 18*c*), peripheral wall portions 18*d* uprightly extend in directions perpendicular to the planar portion 18*b* and the side-plate portion 18*c*. In the embodiment, a length L, a width M, and a height N of the insulating member 18 are set at 3.0 mm, 2.4 mm, and 0.7 mm, respectively. However, these dimensions are not limited to the values, respectively. A height P from the planar portion 18*b* of the peripheral wall portion 18*d* and a height Q from the side-plate portion 18*c* are set at 0.3 mm and 0.4 mm, respectively. These dimensions are not limited to the values.

Figure 4:
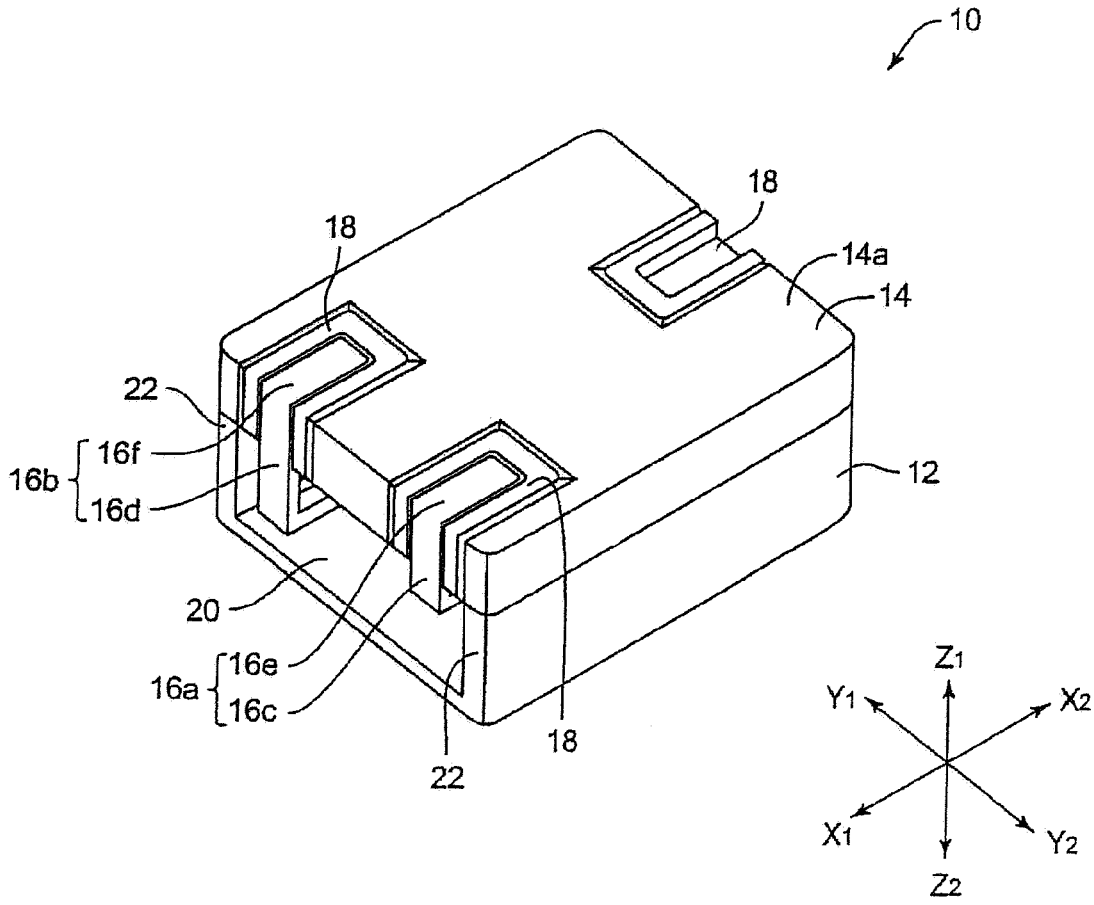
FIG. 4 is a perspective view showing the configuration of the inductor according to the first embodiment of the present invention and showing a state in which a surface mounted on the substrate faces upward.

FIG. 4 is a perspective view showing the configuration of the inductor 10 according to the first embodiment of the present invention and showing a state in which a surface mounted on a substrate faces upward.

The winding 16 is fitted on the winding core portion 24 of the E-type core 12, and the I-type core 14 is arranged above the winding 16. The I-type core 14 is fixed to the E-type core 12 through an adhesive agent between an upper end face 22*f* of the wall portion 22 and a lower-side surface of the I-type core 14. Furthermore, the insulating members 18 are arranged in the recessed portions 26, 27, and 28 formed in the I-type core 14, and the bent portion 16*c* and the folded portion 16*e* of the end 16*a* are arranged to be in contact with the side-plate portion 18*c* and the planar portion 18*b* of the insulating member 18 arranged in the recessed portion 26. In addition, the bent portion 16*d* and the folded portion 16*f* of the end 16*b* are arranged to be in contact with the side-plate portion 18*c* and the planar portion 18*b* of the insulating member 18 arranged in the recessed portion 27. The insulating member 18, the recessed portions 26, 27, and 28, the ends 16*a* and 16*b*, and the insulating member 18 are fixed through an adhesive agent. In this manner, the inductor 10 is manufactured as shown in FIG. 4. In the inductor 10, the height H of the recessed portions 26 and 27 and the height N of the insulating member 18 are equal to each other, i.e., 0.7 mm. For this reason, when the insulating members 18 are arranged in the recessed portions 26 and 27, respectively, the substrate mounting surface 14*a* and an upper end face 18*e* of the insulating member 18 constitute the same plane. Both the folded portions 16*e* and 16*f* slightly upwardly project from the same plane.

In the inductor 10 structured as described above, the folded portions 16*e* and 16*f* are arranged in the recessed portions 26 and 27 recessed from the substrate mounting surface 14*a* in a direction of height of the I-type core 14 through the insulating members 18, respectively. Therefore, the height of the I-type core 14 corresponding to the heights of the recessed portions 26 and 27 is effectively utilized. As a result, the inductor 10 can achieve a low profile. Since the insulating members 18 are interposed between the ends 16*a* and 16*b* and the recessed portions 26 and 27, electric insulating property between the substrate surfaces on which the I-type core 14 is mounted is secured.

In the inductor 10, the winding 16 is constituted by a flat wire, and the folded portions 16*e* and 16*f* at the ends 16*a* and 16*b* of the winding 16 are used as terminals. For this reason, terminals need not to be arranged as different members, the configuration of the inductor 10 is simplified, and the number of parts can be reduced.

In the inductor 10, the folded portions 16*e* and 16*f* slightly upwardly project from the same plane constituted by the substrate mounting surface 14*a* and the upper end face 18*e* of the insulating member 18. With this configuration, when the inductor 10 is mounted on a substrate, the folded portions 16*e* and 16*f* are brought into contact with a land pattern of a mounting substrate. Therefore, the winding 16 and the land pattern of the mounting substrate can be reliably connected to each other, and the inductor 10 can be suppressed from increasing in height.

Second Embodiment

An inductor 30 according to a second embodiment of the present invention will be described below with reference to the accompanying drawings. The same reference numerals as in the first embodiment denote the same parts in the inductor 30 according to the second embodiment, and a description thereof will not be described.

Figure 5:
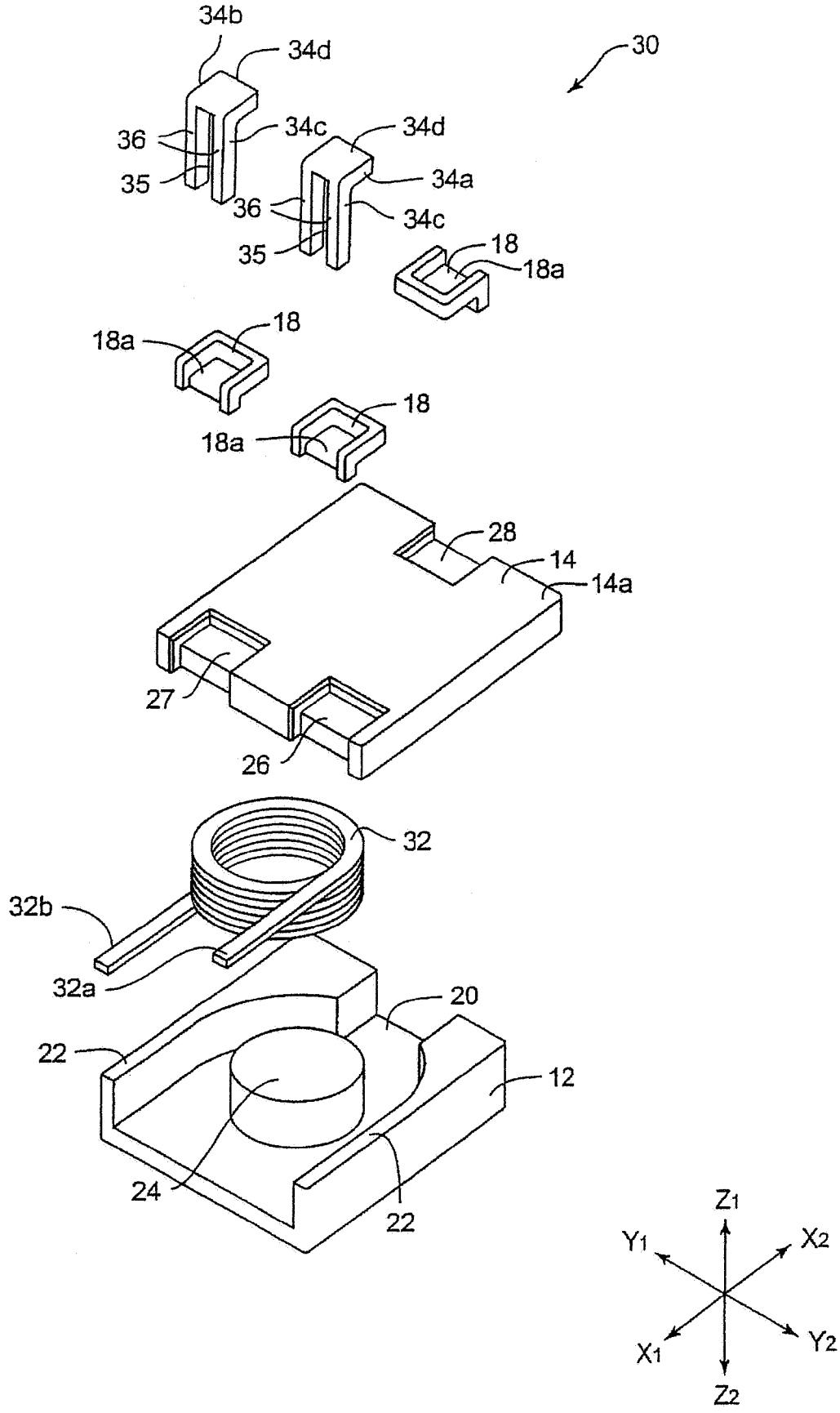
FIG. 5 is an exploded perspective view showing the configuration of an inductor according to a second embodiment of the present invention and showing a state in which a surface mounted on a substrate faces upward.
Figure 6:
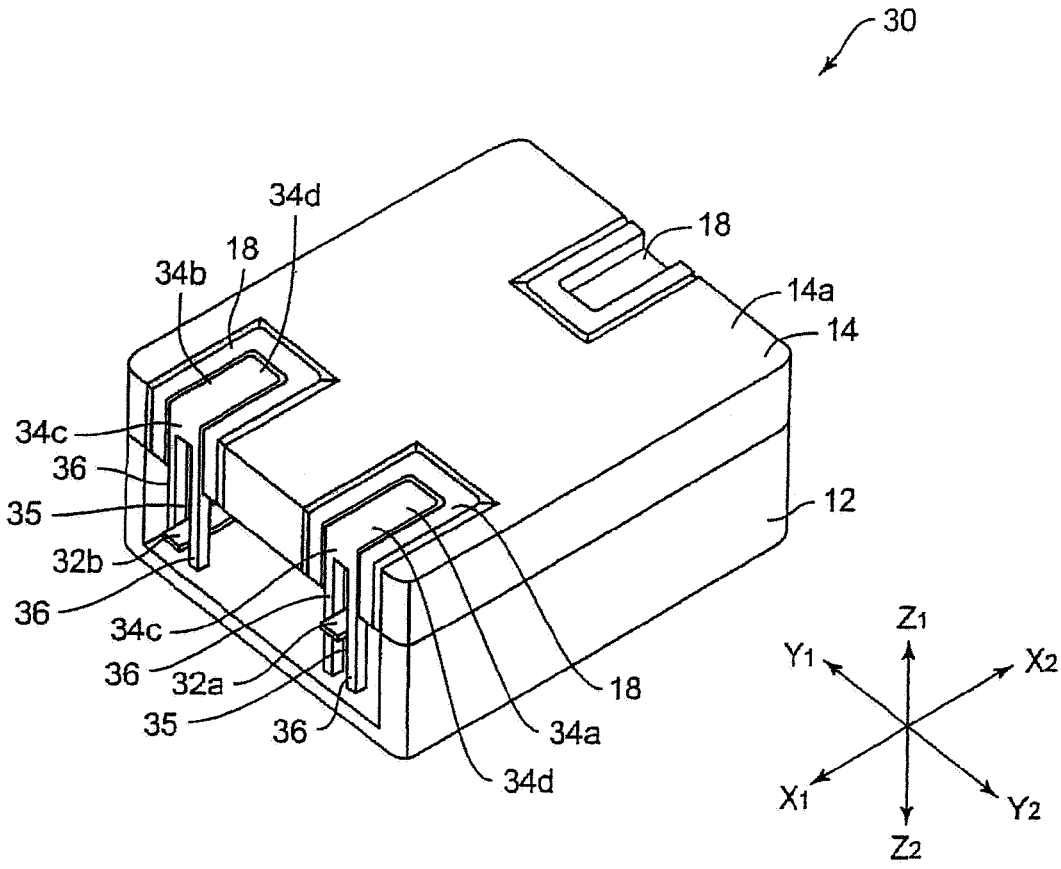
FIG. 6 is a perspective view showing the configuration of the inductor according to the second embodiment of the present invention and showing the state in which the surface mounted on the substrate faces upward.

FIG. 5 is an exploded perspective view showing the configuration of the inductor 30 according to the second embodiment of the present invention and showing a state in which a surface mounted on a substrate faces upward. FIG. 6 is a perspective view showing the configuration of the inductor 30 according to the second embodiment of the present invention and showing the state in which the surface mounted on the substrate faces upward.

The inductor 30, as shown in FIG. 5, is a surface-mount type inductor which is mainly constituted by an E-type core 12, an I-type core 14, a resin insulating member 18, a winding 32, and terminals 34*a* and 34*b*.

As shown in FIG. 5, the winding 32 is fitted on the winding core portion 24 of the E-type core 12 and arranged to be brought into contact with the inner side of the wall portion 22 and the bottom surface portion 20 as in the first embodiment. The winding 32 is formed by coaxially winding a flat wire having conductivity and covered with an insulating film such as an enamel film in advance. As a material of the flat wire, a metal such as copper having good conductivity is preferably used. However, a metal such as iron or aluminum may be used. An end 32(*a*) and an end 32(*b*) of the winding 32 extend in a direction tangent to the cylinder of the winded winding 32. The end 32(*a*) and the end 32(*b*) are terminals which are not covered with an insulating film and which can be electrically connected to an external device.

As shown in FIG. 5, after the winding 32 is arranged inside the E-type core 12, the I-type core 14 is arranged above the E-type core 12. Three insulating members 18 are arranged in recessed portions 26, 27, and 28 of the I-type core 14, respectively. Furthermore, terminals 34*a* and 34*b* are arranged on substrate portions 18*a* of the insulating members 18 arranged in the recessed portions 26 and 27, respectively. The terminals 34*a* and 34*b* are fixed through an adhesive agent into the recessed portions 26 and 27. Each of the terminals 34*a* and 34*b* has a shape obtained by bending a metal flat plate having conductivity like an L shape. In each of the terminals 34*a* and 34*b*, a notched portion 35 upwardly notched in a substantially rectangular shape in a plane is formed at an almost center of a lower end portion 34*c* constituting one L-shaped end in directions on the front side and the rear side. The notched portion 35 is formed to form two leg portions 36 on both the sides of the notched portion 35 at the lower end portion 34*c*.

As shown in FIG. 6, when the terminal portions 34*a* and 34*b* are arranged on the insulating members 18, a lower-side surface of an upper end portion 34*d* constituting an L-shaped other terminal is brought into contact with the planar portion 18*b*, and an inner-side surface of the lower end portion 34*c* near a joint of the corner of the L shape is in contact with the side-plate portion 18*c*. The upper end portions 34*d* of the terminal portions 34*a* and 34*b* slightly upwardly project from the same plane constituted by the substrate mounting surface 14*a* and the upper end face 18*e* of the insulating member 18. When the terminal portions 34*a* and 34*b* are arranged on the insulating members 18, the ends 32(*a*) and 32(*b*) are inserted into the notched portions 35 to sandwich the leg portions 36 formed on the terminal portions 34*a* and 34*b*, respectively.

In the inductor 30 having the above configuration, the terminal portions 34*a* and 34*b* are arranged in the recessed portions 26 and 27 recessed from the substrate mounting surface 14*a* in a direction of height of the I-type core 14 through the insulating members 18, and the ends 32(*a*) and 32(*b*) are connected to the terminal portions 34*a* and 34*b*, respectively. Therefore, the height of the I-type core 14 corresponding to the heights of the recessed portions 26 and 27 can be effectively utilized. As a result, the inductor 30 can achieve a low profile. The insulating members 18 are interposed between the terminal portions 34*a* and 34*b* and the recessed portions 26 and 27. For this reason, electric insulating property between the mounting substrate surface and the I-type core 14 can be secured. Furthermore, the terminal portions 34*a* and 34*b* are arranged as different members, so that the inductor 30 can be reliably connected to the mounting substrate.

Third Embodiment

An inductor 40 according to a third embodiment of the present invention will be described below with reference to the accompanying drawings. The same reference numerals as in the first embodiment and the second embodiment denote the same parts in the inductor 40 according to the third embodiment, and a description thereof will not be described.

Figure 7:
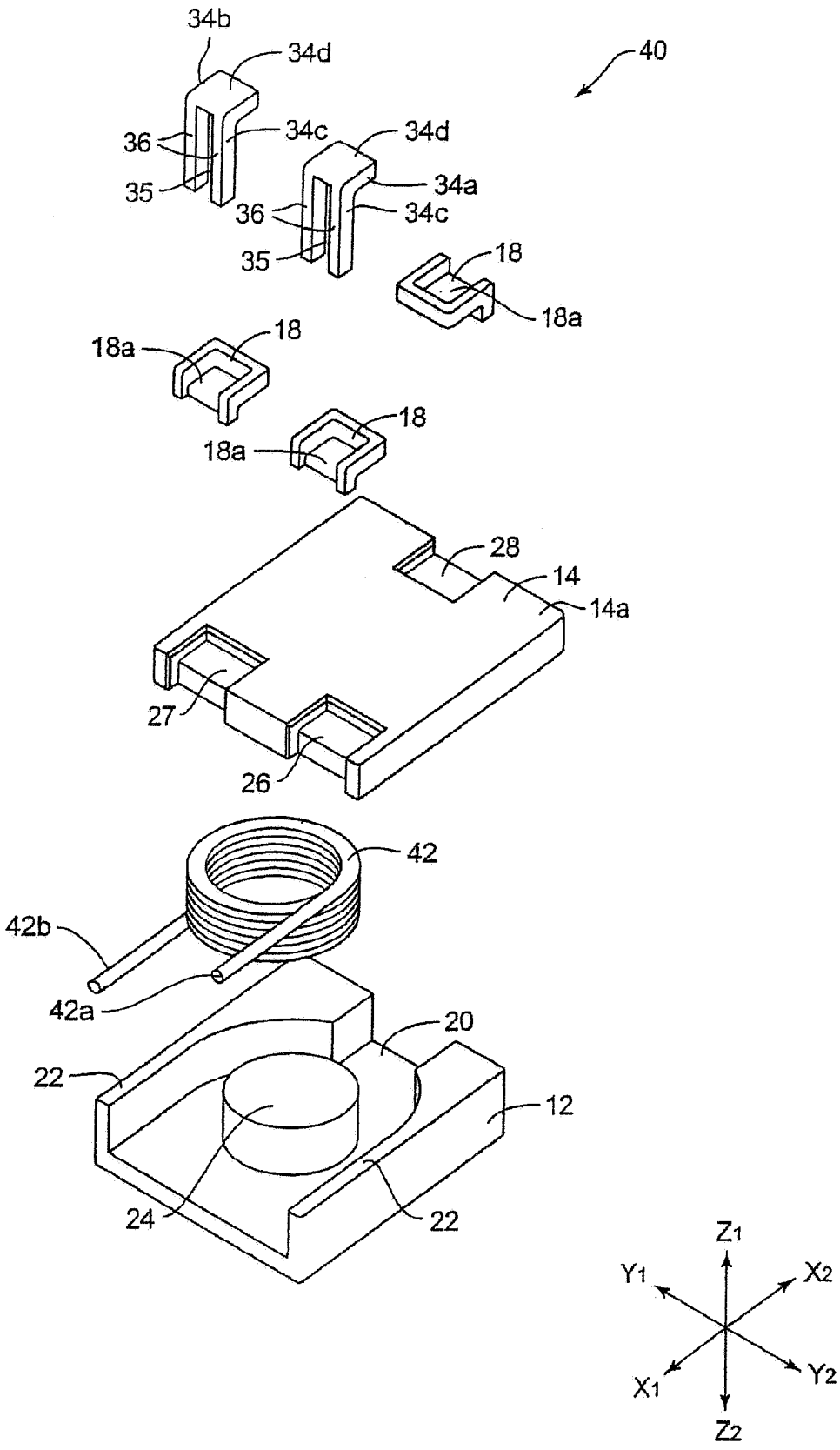
FIG. 7 is an exploded perspective view showing the configuration of an inductor according to a third embodiment of the present invention and showing a state in which a surface mounted on a substrate faces upward.
Figure 8:
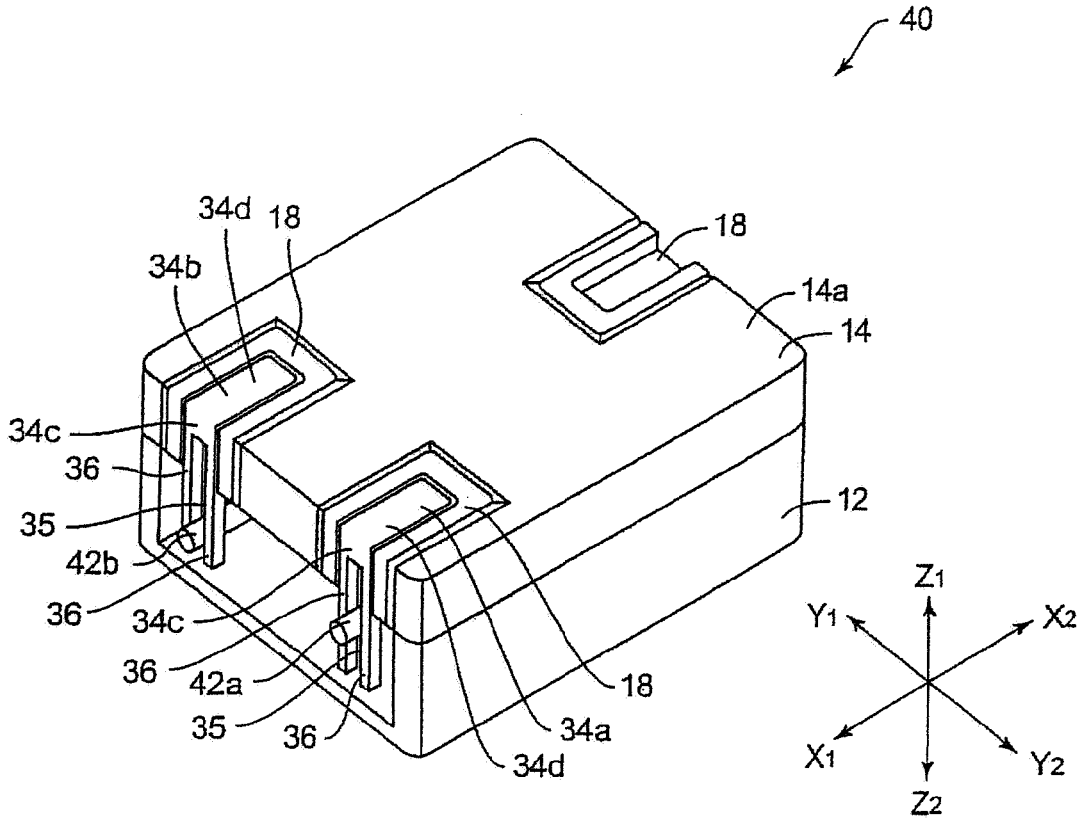
FIG. 8 is a perspective view showing the configuration of the inductor according to the third embodiment of the present invention and showing the state in which the surface mounted on the substrate faces upward.

FIG. 7 is an exploded perspective view showing the configuration of the inductor 40 according to the third embodiment of the present invention and showing a state in which a surface mounted on a substrate faces upward. FIG. 8 is a perspective view showing the configuration of the inductor 40 according to the third embodiment of the present invention and showing the state in which the surface mounted on the substrate faces upward.

The inductor 40, as shown in FIG. 7, is a surface-mount type inductor which is mainly constituted by an E-type core 12, an I-type core 14, a resin insulating member 18, a winding 42, and terminals 34*a* and 34*b*.

As shown in FIG. 7, the winding 42 is fitted on the winding core portion 24 of the E-type core 12 and arranged to be brought into contact with the inner side of the wall portion 22 and the bottom surface portion 20 as in the first embodiment. The winding 42 is formed by coaxially winding a round wire having conductivity and covered with an insulating film such as an enamel film in advance. As a material of the round wire, a metal such as copper having good conductivity is preferably used. However, a metal such as stainless steel, iron, or aluminum may be used. An end 42(*a*) and an end 42(*b*) of the winding 42 extend in a direction tangent to the cylinder of the winded winding 42. The end 42(*a*) and the end 42(*b*) are not covered with an insulating film and can be electrically connected to an external device.

As shown in FIG. 7, after the winding 42 is arranged inside the E-type core 12, the I-type core 14 is placed above the E-type core 12. Three insulating members 18 are arranged in recessed portions 26, 27, and 28 of the I-type core 14, respectively. Furthermore, the terminal portions 34*a* and 34*b* are arranged on the substrate portions 18*a* of the insulating members 18 arranged in the recessed portions 26 and 27, respectively. As shown in FIG. 8, when the terminal portions 34*a* and 34*b* are arranged on the insulating members 18, upper end portions 34*d* of the terminal portions 34*a* and 34*b* slightly upwardly project from the same plane constituted by the substrate mounting surface 14*a* and the upper end face 18*e* of the insulating member 18. When the ends 42(*a*) and 42(*b*) are inserted into the notched portions 35 to sandwich the leg portions 36 formed on the terminal portions 34*a* and 34*b*, respectively.

In the inductor 40 having the above configuration, the terminal portions 34*a* and 34*b* are arranged in the recessed portions 26 and 27 recessed from the substrate mounting surface 14*a* in a direction of height of the I-type core 14 through the insulating members 18, and the ends 42(*a*) and 42(*b*) are connected to the terminal portions 34*a* and 34*b*, respectively. Therefore, the height of the I-type core 14 corresponding to the heights of the recessed portions 26 and 27 can be effectively utilized. As a result, the inductor 40 can achieve a low profile. The insulating members 18 are interposed between the terminal portions 34*a* and 34*b* and the recessed portions 26 and 27. For this reason, electric insulating property between the mounting substrate surface and the I-type core 14 can be secured. Furthermore, the terminal portions 34*a* and 34*b* are arranged as different members, so that the inductor 40 can be reliably connected to the mounting substrate.

As described above, one embodiment of the present invention has been described, but the present invention is not limited to the above-described embodiments, and various modified embodiments could be implemented.

In each of the above embodiments, the depth K of the notched portion 26*b* is 0.8 mm, and a height R from the side-plate portion 18*c* of the insulating member 18 to the peripheral wall portion 18*d* is 0.85 mm. However, for example, when the height R is made equal to the depth K (0.8 mm), the left-side end face 14*b* of the E-type core 12 and a side end face 18*f* of the insulating member 18 may constitute the same plane when the insulating member 18 is arranged in the recessed portion 26. The insulating member 18 arranged in the recessed portion 27 is the same as described above. With this configuration, the insulating member 18 does not project outside the E-type core 12, and the inductors 10, 30, and 40 are suppressed from increasing in a horizontal direction.

In each of the embodiments, the folded portions 16*e* and 16*f* and the upper end portions 34*d* slightly upwardly project from the same plane constituted by the substrate mounting surface 14*a* and the upper end face 18*e* of the insulating member 18. The folded portions 16*e* and 16*f* and the upper end portions 34*d* may be arranged on the same plane as that of the substrate mounting surface 14*a* and the upper end face 18*e*.

In each of the embodiments, a core arranged on a side on which the inductor is not mounted is the E-type core 12. As the core, another type of core such as an X core, an LP core, or an EP core may be used.

The inductor according to the present invention can be used in various appliances such as a mobile phone, a personal computer, and a television set.

What is claimed is:

1. A substrate-mounting type inductor having:

a conductive winding;

a core on which the conductive winding is wound; and an insulating member;

the conductive winding comprising:

a terminal portion located at an end of the conductive winding;

the core comprising:

a recessed portion which is recessed in a height direction of the core and formed on a substrate mounting surface of the core;

wherein the terminal portion is arranged to be housed in the recessed portion;

wherein the insulating member is located between the terminal portion and the recessed portion; and wherein the insulating member does not extend away from the substrate mounting surface of the core.

2. The inductor according to claim 1;

wherein a part of the terminal portion and a part of the insulating member are coplanar with a surface of the core.

3. The inductor according to claim 1;

the core further comprising:

an E-type core comprising a middle leg which supports the conductive winding; and a plate-like I-type core arranged to cover an open surface of the E-type core.

4. The inductor according to claim 3;

wherein the recessed portion is formed on a surface of the I-type core.

5. The inductor according to claim 1;

wherein the conductive winding further comprises a flat wire, and an end of the flat wire is used as the terminal portion.

6. The inductor according to claim 5;

wherein a part of the terminal portion and a part of the insulating member are coplanar with a surface of the core.

7. The inductor according to claim 5;

the core further comprising:

an E-type core comprising a middle leg which supports the conductive winding; and a plate-like I-type core arranged to cover an open surface of the E-type core.

* * * * *